US005313731A

United States Patent [19]

Falchi

[11] Patent Number: 5,313,731

[45] Date of Patent: May 24, 1994

[54] PLATE SUPPORT FOR ELECTRIC CONTROL AND SIGNALING UNITS, PERMITTING INSERTION OF A PLATE INTO AND SEPARATION AND REMOVAL OF THE PLATE FROM THE PLATE SUPPORT

[75] Inventor: Fiorino Falchi, Sangano, Italy

[73] Assignee: CGE Compagnia Generale Elettromeccanica SpA, Milan, Italy

[21] Appl. No.: 987,154

[22] Filed: Dec. 8, 1992

[30] Foreign Application Priority Data

Dec. 17, 1991 [IT] Italy ..... MI91 U 01107

[51] Int. Cl.[5] ..... G09F 3/18

[52] U.S. Cl. ..... 40/642; 40/653

[58] Field of Search ..... 40/642, 653; 200/308, 200/309

[56] References Cited

U.S. PATENT DOCUMENTS 3,727,333 4/1973 Ward et al. ..... 40/642
4,270,287 6/1981 Gimbel ..... 40/642
4,884,353 12/1989 Taylor .

FOREIGN PATENT DOCUMENTS 8804230 6/1988 Fed. Rep. of Germany .
2561118 9/1985 France .
860032 2/1961 United Kingdom .

OTHER PUBLICATIONS

General Electric Catalogue, "Control and Signalling Limits", p. 7, Apr. 1987.

*Primary Examiner*—Clifford D. Crowder
*Assistant Examiner*—Gloria Hale
*Attorney, Agent, or Firm*—Helfgott & Karas

[57] ABSTRACT

A support for a display plate for electric control and signaling units has a frame portion receiving the plate and supporting the same on two inwardly extending protrusions thereof, and a table portion which has a recess for receiving a fastening ring nut of a control and signaling unit. Two support members are provided in the frame portion, which permit flexion and bending of the plate when the latter is pressed by a finger of the user so as to disengage and release the plate from the frame portion without the use of any tool.

3 Claims, 3 Drawing Sheets

FIG.2
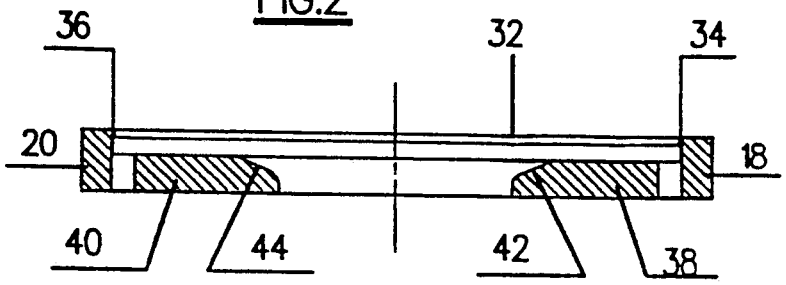
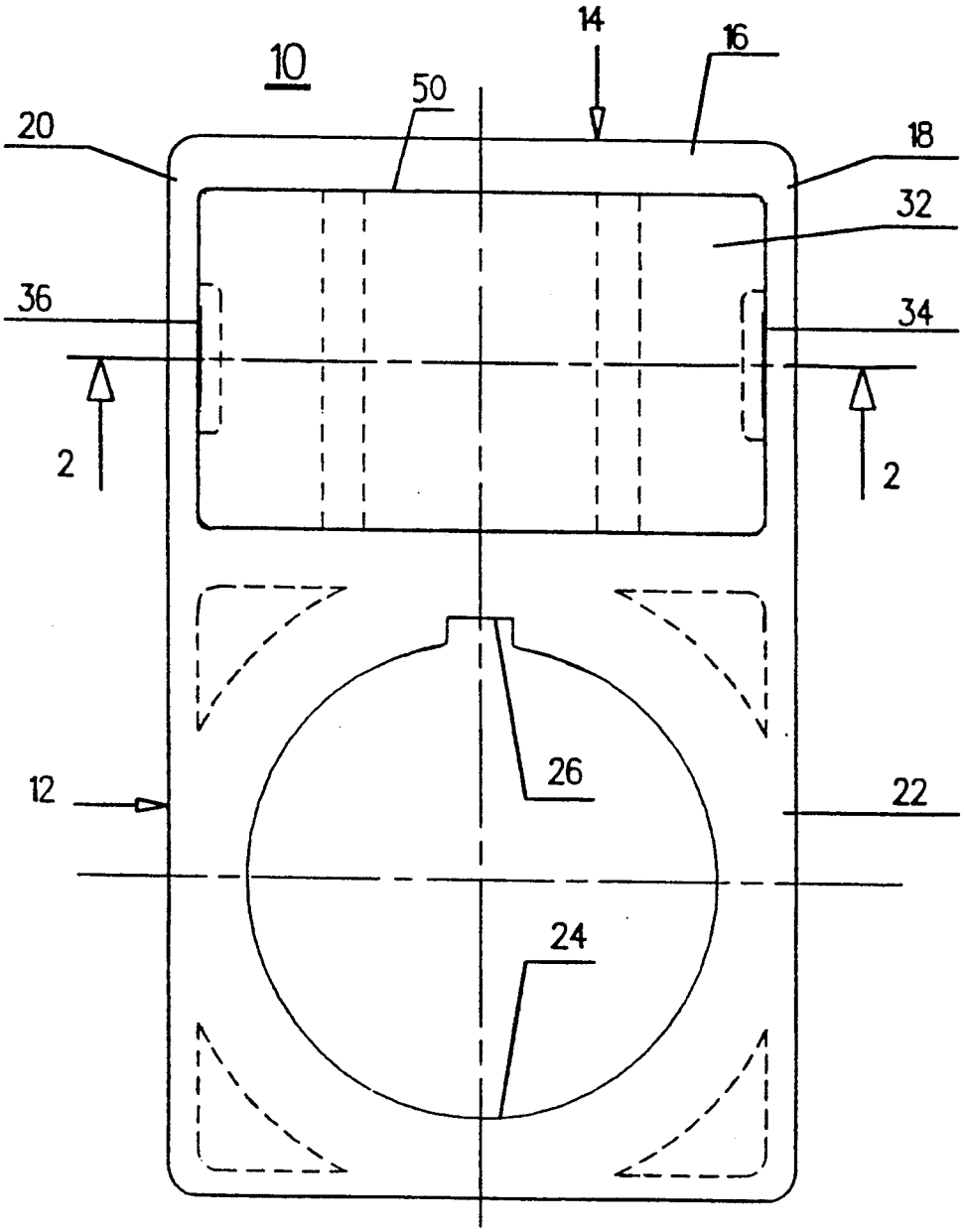
FIG.1

PLATE SUPPORT FOR ELECTRIC CONTROL AND SIGNALING UNITS, PERMITTING INSERTION OF A PLATE INTO AND SEPARATION AND REMOVAL OF THE PLATE FROM THE PLATE SUPPORT

BACKGROUND OF THE INVENTION

The present invention relates to a support for plates used for marking or displaying information on electric control members and/or signaling members, such as handles, pushbuttons and lights usually used in control boards. Such a support is made in such a way that a plate suited therefor can be hand-inserted thereinto and removed therefrom by hand with ease.

There has been a long time need for marking control and signalling members by means of plates bearing thereon written or drawn suitable symbols, words, figures or drawings for an unambiguous indication of every specific control or signaling member. There are many kinds of such plates which can be somehow fastened near the control and signaling members. Such plates are fastenable to a board by the use of an adhesive layer, rivets, screws or the like.

Another largely known way of fastening the plates included providing a plate with a bore or a window wherein a stem or sleeve is passed for fastening a control or signaling member to a control board so that the fastening of the member itself was achieved by fastening the plate to the board. This second way of fastening has been undoubtedly easier, more practical and simpler than the preceding one because it in no way affected the external surface of the control board. The second way of fastening, however, has the drawback that for changing a plate it is necessary to unscrew a ring nut of the control or signaling member itself, which is not always easy, especially for the members fastened to the back side of the board, as, e.g., such as disclosed in European Patent No. 0,105,387, granted on Mar. 25, 1987, to the applicant of the present application. Fastening the nuts to the back side of the board requires access behind the board and the use of a specific tool for unscrewing the nut.

SUMMARY OF THE INVENTION

It is an object of the present invention to provide a plate support which is fastened to a control board including one or more control or signaling members, and permits insertion, separation and removal of a plate into and from the support without separating the support from the board.

It is another object of the present invention to provide a plate replacement on the support for operation in front of the board.

A further object of the invention is to provide a support permitting a plate replacement without any auxiliary tool.

The above-mentioned objects are attained by a plate support comprising a frame portion surrounding a plate having a shape mating that of said frame portion and adjacent to means for fastening the frame portion to a fastening ring nut of a control or signaling member.

The frame portion may be manufactured integral with a planar table portion provided with a bore wherein a ring nut of a control or signaling member can be inserted.

More specifically, the frame portion is of a substantially rectangular shape and is configured to house a plate of such a shape and size that fits with the frame portion. The frame portion may be provided with at least one protrusion for fastening the plate to the frame portion once the plate has been forcefully inserted therein.

Preferably, the frame portion is provided with two protrusions on opposite sides thereof to engage two opposite sides of the plate when the latter is inserted into the frame portion.

Further, the support has frame disengaging means consisting of at least an intermediate support which leaves a space to permit a flexion of the plate so as to move the plate out of engagement with the protrusions on the sides of the frame portion.

Preferably, the supports are two in number, and between them, there is such a space left to permit the descent of the plate between the supports themselves to lift the edges of the plate in order to take them out of engagement with the protrusions of the frame portion.

More preferably, the two supports are provided with smooth bevels to permit a lateral sliding of the plate once the edges of the supports are disengaged from the frame protrusions.

BRIEF DESCRIPTION OF THE DRAWINGS

The features of the present invention will be completely defined in the claims forming the concluding portion of the present description; however, further features and advantages will appear more completely from the following detailed description of an embodiment, and given in exemplifying but not limiting way in the enclosed drawings in which:

FIG. 1 is a front view of a plate support according to the present invention;

FIG. 2 is a sectional view taken along line 2-2 of FIG. 1;

DETAILED DESCRIPTION OF THE PREFERRED EMBODIMENT

Figure 3:
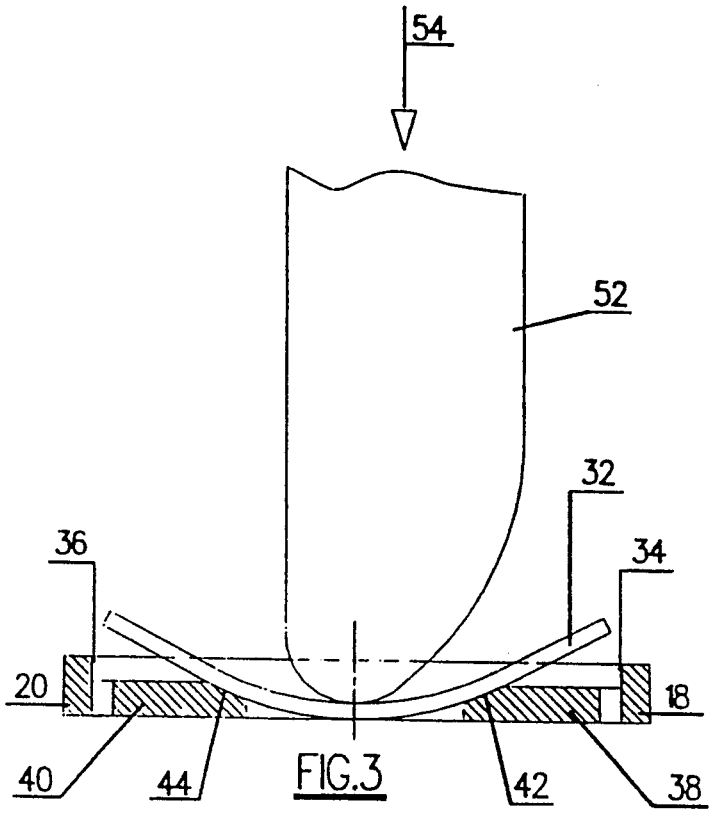
FIG. 3 is a sectional view similar to that of FIG. 2 and depicting a release and separation of a plate from the frame protrusions by intervention of an operator's finger substantially at the center of the plate.

Referring first to FIGS. 1 and 2, it is seen that a plate support 10 consists of a planar plate member 12 which includes a substantially rectangular frame portion 14 having three walls or sides 16, 18 and 20, and adjacent to a planar table portion 22 having a substantially circular bore 24 provided with a recess 26 for arranging the support 10 in respect to a control and/or signaling member and receiving a fastening means. A plate 32 is housed in a seat 50 of frame 14 of support 10, as shown in FIGS. 1 and 2. Seat 50 is of a rectangular shape.

The plate 32 which contains marks or symbols useful for the associated control and/or signaling member, is inserted into the frame portion 14, engaged under protrusions 34 and 36 provided on the sides 18 and 20 of the frame portion 14.

The plate 32 rests on two supports or cross members 38 and 40 connecting the side or wall 16 and the planar table portion 22 defining the frame portion 14. The cross members 38 and 40 are provided with beveled faces 42 and 44, of circular shape or the like to promote the disengagement of the plate 32 from the protrusions 34 and 36, as it will be disclosed in detail below.

Referring now to FIGS. 3 to 6, it is seen that the plate support of the invention operates as follows:

In order to insert the plate 32 into seat 50, defined by frame portion 14 and the cross members 38 and 40, the plate is laid on the frame portion 14 in alignment with the seat 50 and the plate itself is uniformly pushed onto the whole surface until, with a little bending, two of its opposite sides or edges clear the protrusions 34 and 36, aided by their trapezoidal shape, and are inserted thereunder, assuring a complete fastening of the plate 32 in the seat 50.

Figure 4:
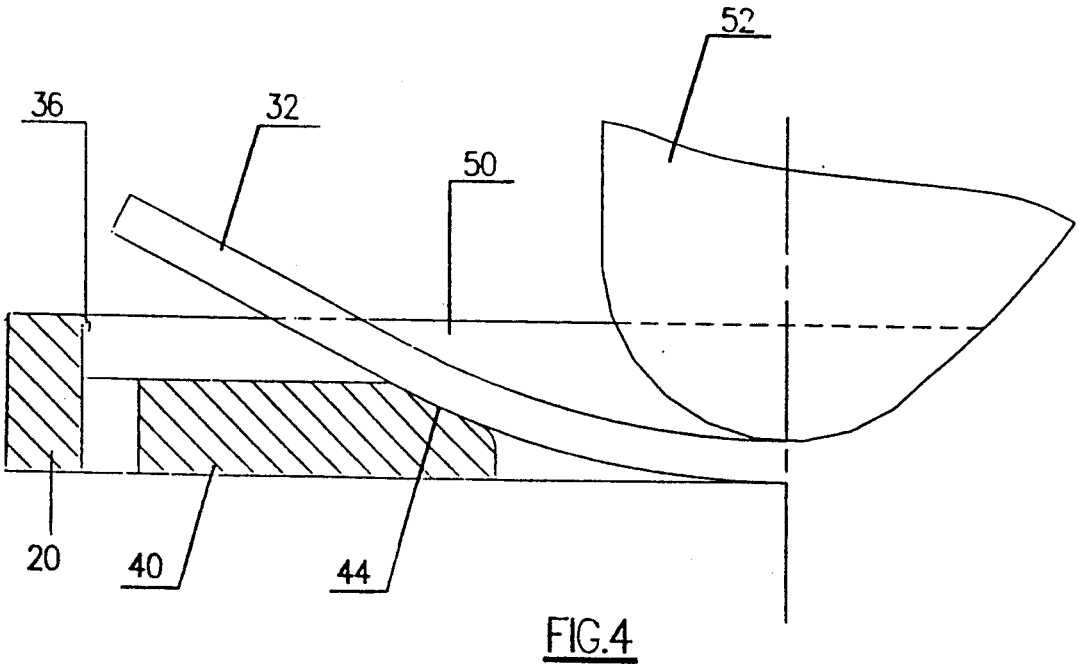
FIG. 4 is an enlarged partial cross-sectional view similar to that of FIG. 3, but depicting in more detail the mechanism of release of the plate from the frame protrusions.
Figure 5:
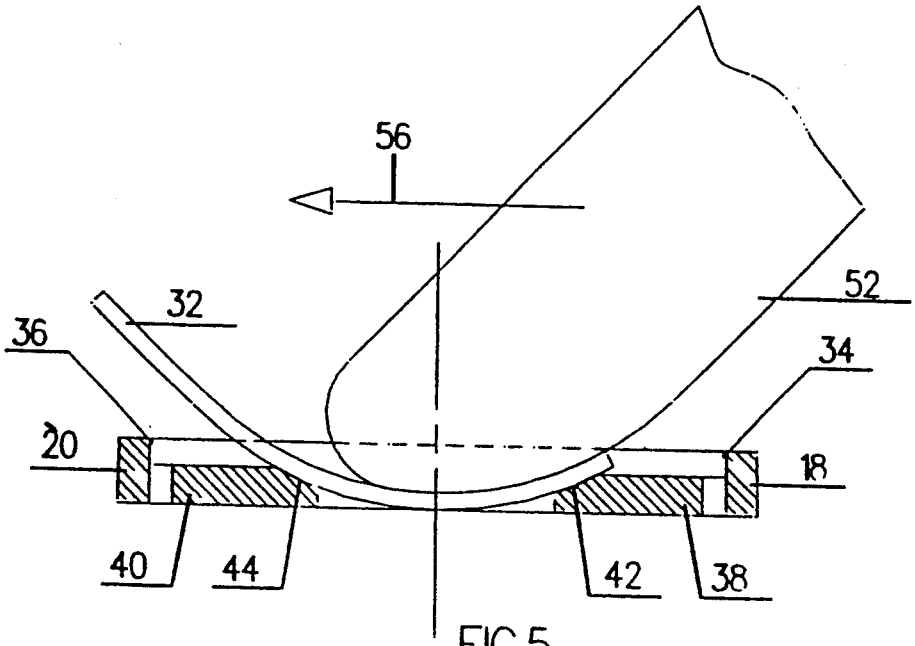
FIG. 5 is a sectional view, similar to that of FIGS. 2 and 3, depicting the removal of the plate from the frame portion of the support.

For separating and removing the plate 32 from the seat 50, an operator presses his or her finger 52 on the center of plate 32, pushing the latter in the direction of arrow 54, until plate 32 itself sinks down at the center following the beveled faces 42 and 44 of the cross members 38 and 40 and collapsing, as depicted in FIGS. 3 and 4.

Figure 6:
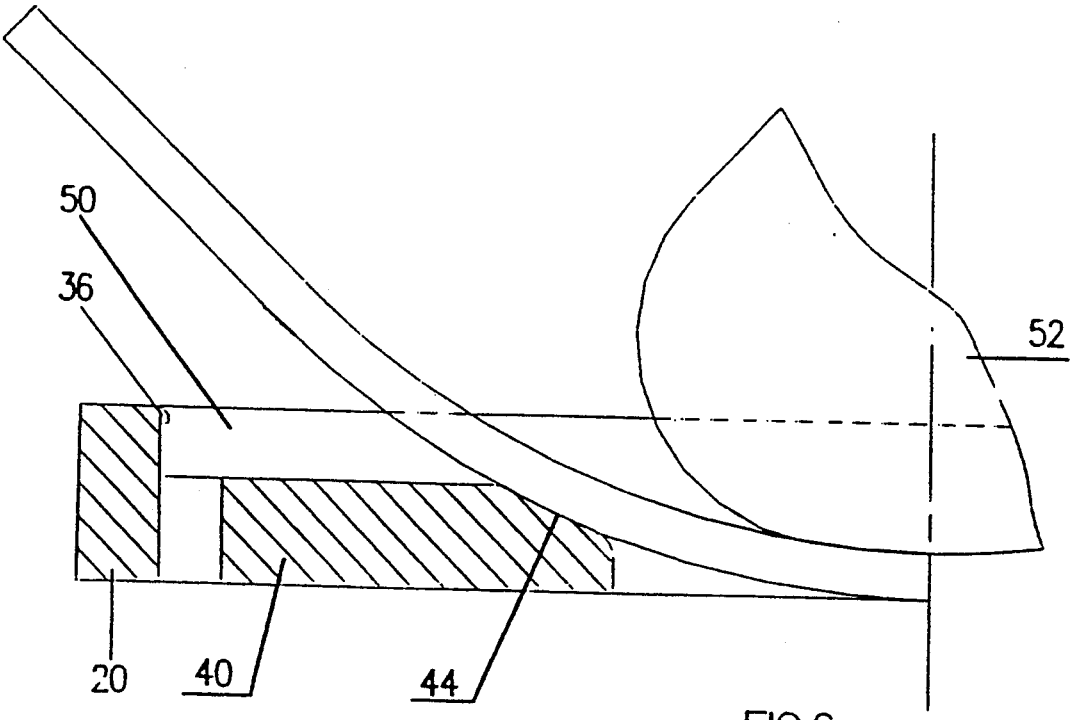
FIG. 6 is an enlarged partial cross-sectional view similar to that of FIG. 5, depicting in more detail the mechanism of removal of the plate from the support.

Then, the finger 52 of the operator is moved in the direction of arrow 56 (FIG. 5), laterally pushing the plate 32 in that direction so that the plate edge slides along the beveled edge 44 of the cross member 40 coming out completely from the seat 50, as shown in FIG. 6.

Of course, the insertion of a subsequent plate will take place with exactly the same insertion process as disclosed in connection with FIGS. 3 and 4.

What has been hereinabove discussed describes a not limiting embodiment of the present invention, so that any person skilled in the art will be able to devise obvious changements and variations to be meant as contained in the coverage thereof.

I claim:

1. A plate support for supporting a display pate for electric control and signaling units, the support comprising a substantially planar frame portion having a seat for receiving said plate from a front side of said frame portion and two side walls, said seat having a shape mating a shape of the plate, said frame portion having side protrusions for supporting edges of the plate in said seat; and a planar table portion adjacent to and formed integrally with said frame portion, said planar table portion being of the same thickness as said frame portion and having a hole for insertion of a ring nut of a respective electric control and signaling member, said frame portion having at a side thereof opposite to said front side, two intermediate support members positioned between said side walls and spaced from each so as to leave therebetween, at a central portion of said frame, a space which allows bending of the plate when the plate is pressed by a finger of the user to cause disengagement of said edges of the plate from said side protrusions and release of the plate without use of any tool.

2. The plate support according to claim 1, wherein said two support members are provided with internal beveled surfaces facing said seat and which promote lateral sliding of the plate when said edges of the plate are disengaged from said protrusions.

3. The plate support according to claim 1, wherein said frame is substantially rectangular and wherein said protrusions fasten the plate in the frame portion.

* * * * *